US006125653A

United States Patent [19]

Shu et al.

[11] Patent Number: 6,125,653

[45] Date of Patent: Oct. 3, 2000

[54] LNG WITH ETHANE ENRICHMENT AND REINJECTION GAS AS REFRIGERANT

[75] Inventors: Steven W. Shu, The Woodlands; Francis A. Christiano, II, Sugar Land, both of Tex.

[73] Assignee: Texaco Inc., White Plains, N.Y.

[21] Appl. No.: 09/299,259

[22] Filed: Apr. 26, 1999

[51] Int. Cl.[7] ..... F25J 3/00

[52] U.S. Cl. ..... 62/622; 62/48.2; 62/631

[58] Field of Search ..... 62/622, 631

[56] References Cited

U.S. PATENT DOCUMENTS

| | | | |
|---|---|---|---|
| 3,213,631 | 10/1965 | Kniel | 62/622 |
| 3,520,143 | 7/1970 | Becker | 62/622 |
| 4,411,676 | 10/1983 | Tedder | 62/631 |

OTHER PUBLICATIONS

Report entitled "Putting a New Emphasis on LNG," from Phillips LNG Ventures, Rev. Feb. 1998.

Article entitled "Gas Liquids Recovery Technology" by Ortloff Engineers, Ltd., Midland, Tx.

Article entitled "Major Advantages to Siting LNG Plant Offshore," by Chris Dubar, et al., *Offshore*, Aug. 1998.

Report entitled "Capabilities and Experience Gas Processing and LNG," by Black & Veatch Pritchard, pp. 1–82.

Article entitled "A Competitive Offshore LNG Scheme Utilizing a Gravity Base Structure and Improved Nitrogen Cycle Process," by Chris Dubar, et al., BHP Petroleum, pp. 1–21.

Report entitled "LNG Capabilities," including background materials, of Air Products and Cemicals, Inc., 1998.

Report entitled "Presentation of LNG Technology," by Linde for Texaco, Jun. 10, 1998.

*Primary Examiner*—Ronald Capossela

*Attorney, Agent, or Firm*—Morris N. Reinisch; Howrey Simon Arnold & White

[57] ABSTRACT

The present invention comprises a process for producing liquefied natural gas from the methane that is produced during natural gas liquids extraction. The process includes distilling the feed to extract methane, then cooling and expanding the methane to produce liquefied natural gas and cold methane vapor. The cold methane vapor is employed as a coolant to precool the feed and to cool the methane before expansion, and is then recompressed for reinjection into the well formation. The bottoms from the methane distillation may be further distilled to extract ethane, which may be cooled with the cold methane vapor and combined with the liquefied natural gas product. A portion of the recompressed methane may be diverted from the compressor train, cooled and expanded to produce additional liquefied natural gas and cold methane vapor.

28 Claims, 1 Drawing Sheet

LNG WITH ETHANE ENRICHMENT AND REINJECTION GAS AS REFRIGERANT

BACKGROUND OF THE INVENTION

The production of liquefied natural gas (LNG) is carried out at cryogenic temperatures, typically at about −260 degrees Fahrenheit (−162° C.). These low process temperatures are typically achieved by the use of an external refrigeration system that employs either a mixture of refrigerants in a single loop or a cascade of pure refrigerants. Either process requires a large input of compressor work to achieve the low temperature. In fact, the recognition that this power input is a requirement of all commercial LNG processes has led the industry to adopt a measure of efficiency called "specific power," defined as the energy input required per unit of LNG produced. In addition, the refrigeration equipment required to achieve LNG production temperatures is expensive to purchase and maintain. Generally, the cost of such equipment increases as specific power requirements increase. For both these reasons it is highly desirable to provide a LNG process that minimizes or at least reduces the specific power.

The typical gas feed stream to a LNG plant includes non-associated gas, i.e. gas which is not derived from oil production. This gas feed stream contains primarily methane with minor quantities of ethane, propane and butane. If, however, the gas feed stream is associated gas (i.e. gas which evolves from oil production), it is still predominately methane, but can contain significant quantities of ethane, propane, butane, and $C_5$ and heavier hydrocarbons often referred to as "condensate."

A number of process are reported in the prior art for extracting natural gas liquids (ethane, propane, butane and condensate, known collectively as NGL) from an associated gas stream. These extraction processes typically operate by sequential distillation of the gas stream to extract the individual hydrocarbon components. The stabilized condensate is often added back to the crude oil. Propane and butane fractions are recovered separately and sold while the methane and ethane fractions are typically compressed and reinjected back into the oil reservoir to maintain the formation pressure.

SUMMARY OF THE INVENTION

The present invention provides a single integrated method for implementing a number of enhancements in the production of liquefied natural gas and natural gas liquids. The method includes distilling the methane from the gas feed; cooling the demethanizer overhead with cryogenic methane vapor; expanding the cooled demethanizer overhead to produce the cryogenic methane vapor and liquefied natural gas; and using the cryogenic methane vapor to cool the demethanizer overhead product and the gas feed. The cryogenic methane vapor is then compressed for reinjection into a producing hydrocarbon reservoir. Part of the compressed methane may be cooled and expanded to produce additional liquefied natural gas and additional cryogenic methane vapor for cooling as described above. Thus part of the methane in the feed is used as refrigerant for the liquefaction of the remaining methane. This integration of the process allows the energy generated in the expansion steps to be used to drive external refrigeration units for condensing the demethanizer overhead and cooling the recycled compressed methane.

In a further aspect of the invention, the demethanizer bottoms fraction may be further distilled to produce ethane, which is then liquefied by cooling it with cryogenic methane vapor. This liquid ethane is added to the liquefied natural gas product to enhance its volume and heating value or sold as ethane product.

BRIEF DESCRIPTION OF THE DRAWING

The following drawing forms part of the present specification and is included to further demonstrate certain aspects of the present invention. The invention may be better understood by reference to this drawing in combination with the detailed description of specific embodiments presented herein.

DETAILED DESCRIPTION OF THE INVENTION

Figure 1:
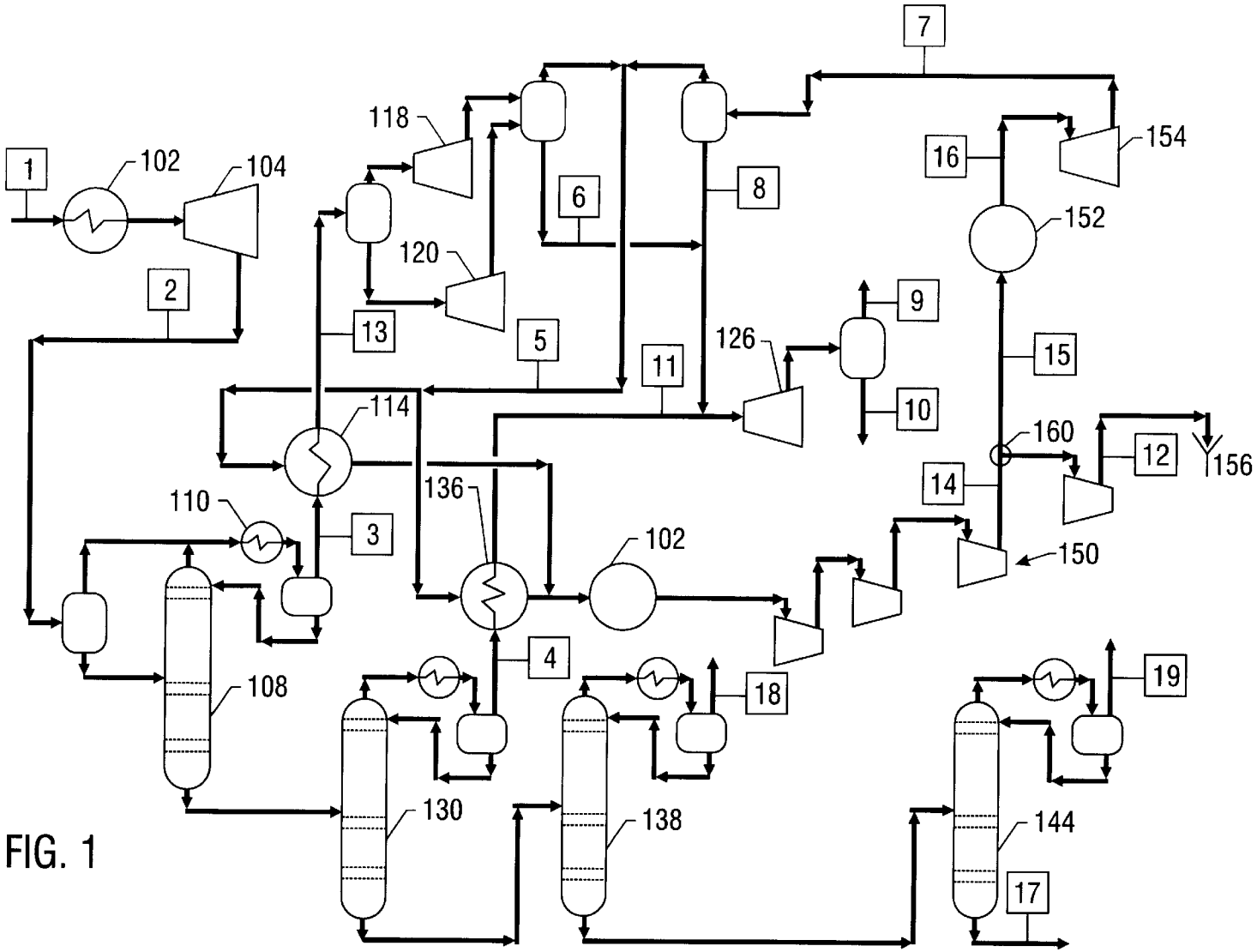
FIG. 1 depicts the integrated LNG/NGL process as further described below.

The following description is included to demonstrate preferred embodiments of the invention. It should be appreciated by those of skill in the art that the apparatus and methods disclosed in the description which follows represent apparatus and methods discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the scope of the invention.

FIG. 1 is a process flow diagram that schematically depicts an exemplary embodiment of the present process. Table 1 below contains exemplary stream flow conditions and rates for the process as shown in FIG. 1.

TABLE 1

| Stream No. | 1 | 2 | 3 | 4 | 5 | 6 | 7 | 8 |
|---|---|---|---|---|---|---|---|---|
| Stream Name | Gas Feed | Gas Feed Expander Outlet | Demethanizer Overhead | Deethanizer Overhead | Cold Recycle Vapor | First Pass LNG | Cold Expander Recycle | Recycle Pass LNG |
| Phase | Vapor | Mixed | Vapor | Vapor | Vapor | Liquid | Mixed | Liquid |
| Rate: lb-mols/hr | 105608 | 105608 | 94600 | 6300 | 107925 | 23137 | 52344 | 15907 |
| Rate: MMTPA | — | — | — | — | — | 1.46 | — | 0.93 |
| Rate: MMSCFD | 962 | — | 862 | 57 | 983 | — | — | — |
| Temperature: ° F. | 110 | −89 | −129 | 41 | −220 | −220 | −220 | −222 |

TABLE 1-continued

| | | | | | | | | |
|---|---|---|---|---|---|---|---|---|
| Pressure: psig | 1900 | 500 | 375 | 340 | 45 | 45 | 50 | 45 |
| LHV | — | — | — | — | — | 1074 | — | 1010 |
| Stream No. | 9 | 10 | 11 | 12 | 13 | 14 | 15 | 16 |
| Stream Name | Fuel Gas | LNG | Ethane to LNG | Reinjection Gas | Cold Demethanizer Overhead | 3rd Stage outlet | Warm Recycle Vapor | Cold Recycle |
| Phase | Vapor | Liquid | Liquid | Vapor | Mixed | Vapor | Vapor | Vapor |
| Rate: lb-mols/hr | 6187 | 39158 | 6300 | 55581 | 94600 | 107898 | 52331 | 52331 |
| Rate: MMTPA | — | 2.71 | 0.68 | — | — | — | — | — |
| Rate: MMSCFD | 56 | — | — | 506 | — | 983 | 477 | 477 |
| Temperature: ° F. | −254 | −254 | −220 | 100 | −143 | 100 | 100 | −49 |
| Pressure: psig | atm. | atm. | 315 | 3500 | 365 | 1700 | 1700 | 1690 |
| LHV | — | 1167 | 1750 | — | — | — | — | — |

The gas feed for the process may comprise any gaseous mixture of hydrocarbons containing at least some methane; however, the feed must be free of impurities such as carbon dioxide, hydrogen sulfide, mercaptans, water, and crude oil, which is generally understood to include hydrocarbons heavier than $C_5$. The gas feed 1 typically enters the process at approximately ambient temperature (110° F. [40° C.]) and at relatively high pressure (typically about 1800–2000 psig [125–140 bar]) and is precooled in feed exchanger 102 by heat exchange with cold methane vapor, the preparation of which will be described below. The precooled gas feed is then expanded in feed expander 104, reducing its pressure by about a factor of about 2–5 and preferably about 4 and inducing auto-refrigeration, which causes the gas feed to cool, preferably to about −89 degrees F. (−67° C.). Although it would be possible to carry out this expansion, as well as the other expansion steps described below, isenthalpically by means of a Joule-Thomson valve or similar device, it is preferable to employ turbo-expanders throughout the process so that the energy released by the gas expansion may be harnessed to supply at least some of the power for external refrigeration equipment required elsewhere in the process.

The expanded feed 2 is then cryogenically distilled in demethanizer 108 to remove methane, and may optionally be further distilled in additional columns 130, 138, 144 to remove ethane 4, propane 18, and butane 19 respectively. In such a sequential distillation process the liquid bottoms fraction from each column is fed to the next distillation column in the train. When this sequential distillation is included in the process, the bottoms fraction from the final distillation 17, here shown as debutanization, consists of condensate substantially free of light ends that can be further processed into gasoline blending stock. The overhead fraction 18 from depropanizer column 138 and the overhead fraction 19 from the debutanizer column 144 are fuel-grade propane and butane and may be sold or used elsewhere in the plant.

The overhead fraction 3 from demethanizer column 108, which contains nearly pure methane at a temperature of about −129° F. (−89° C.), is cooled further in demethanizer overhead chiller 114 by heat exchange with a cold methane vapor 5 to be described below. The cooled methane liquid and vapor are then separately expanded in turbo-expanders 120 and 118 to lower the temperature to about −220° F. (−140° C.) and a pressure of about 45 psig (4.1 bar), thereby producing liquefied natural gas 6 and the previously noted cold methane vapor 5. A final expansion of the liquefied natural gas to ambient pressure in LNG product expander 126 produces the finished LNG product 10 and releases a small amount of fuel gas 9.

It is desirable that the process include a deethanizer 130 for distilling ethane out of the demethanizer bottoms. The deethanizer overhead 4, which in the exemplary case contains about one part methane to seven parts ethane, may be cooled and liquefied in chiller 136 by heat exchange with another portion of the cold methane vapor. The cooled deethanizer overhead 11 may then be combined with the liquefied natural gas 8 prior to its final expansion to ambient pressure in LNG product expander 126. In the exemplary case, virtually all of the ethane that was present in the gas feed 1 would be contained in the LNG product 10, giving the product additional volume and increasing its heating value about 10–15% as compared with pure methane LNG.

As described above, the cold methane vapor 5 that is produced together with the liquefied natural gas is used as a refrigerant to cool the demethanizer and deethanizer overheads 3, 4 in chillers 114, 136 respectively and to precool the gas feed 1 in feed exchanger 102. After having been thus warmed somewhat, the methane vapor is then recompressed in compressor train 150 to high pressure, typically about 3500 psig (240 bar), for reinjection into a hydrocarbon-bearing formation via an injection well 156. Because the present invention relies on the availability of a well formation for reinjection of the excess methane, the process is particularly adapted for use in fields that already employ gas-recycle technology for liquids extraction and reservoir pressure maintenance as described above.

It is also possible, if desired, to produce a second fraction of liquefied natural gas and cold methane vapor 7 by cooling and expanding a portion of the compressed reinjection gas 15, 16. The ratio of first-pass and recycle LNG in the final LNG product is predicted to be about five parts to three parts, although this will of course vary somewhat depending on the operator's choice of pressures and temperatures for carrying out the numerous gas-liquid separations. Because the recycle methane has been compressed to high pressure, expanding it in recycle turbo-expander 154 generates work that may be used to provide power for the external cooling unit 152 located immediately upstream of the recycle expander. Indeed, it is a significant advantage of this invention that the process is designed to employ numerous turbo-expanders 104, 118, 120, 126, 154 that simultaneously cool the process streams and generate work to power other process equipment. In particular, some of the work generated by the expanders may be applied directly to supply power for external refrigeration on the overhead condenser 110 of demethanizer 108.

It should also be clear that another important advantage of the present process is the near-elimination of external refrigeration equipment, common to conventional LNG processes which is costly to purchase and maintain. By employing cold methane vapor, produced within the process, as the process refrigerant, the need for this external refrigeration equipment can be significantly reduced; the remaining equipment may be powered in large part by the expansion work generated throughout the process as described above. The elimination of this equipment greatly simplifies the resulting process. Moreover, because the streams to be cooled and the coolant are both composed primarily of methane, minor exchanger tube leaks present no significant risk of process contamination.

A further advantage of the process as described is that it becomes easy to vary the relative fractions of the total methane that is recovered as LNG 10 on the one hand and that is reinjected 12 on the other. This may be accomplished by selecting the temperature and pressure obtained at the outlet of turbo-expanders 118, 120. The higher the temperature, or the lower the pressure, the greater will be the fraction of cold vapor relative to LNG. Alternatively, the split between recycle gas 15 and reinjection gas 12 may be directly controlled with a splitter valve 160 or the like. As a result, the process may be tailored to produce only as much LNG as is required to meet existing demand. Excess methane is not liquefied, but is simply returned to the reservoir to be extracted whenever it is needed.

It should be apparent to one of skill in the art that the process integration described herein comprises the combination of a number of features whose inclusion enhances the operation of the process in one respect or another but that some of these features may be omitted without departing from the scope of the invention. In particular, it should be apparent that the process as described and claimed would operate without substantial difference if all or part of the ethane were reinjected rather than combined with the liquid product. Similarly, it should be clear from FIG. 1 that the inclusion of a depropanizer and a debutanizer, while possibly important for obtaining a desired condensate product, is in no respect essential to the operability of the LNG production and gas reinjection segments of the process.

In view of the above disclosure, one of ordinary skill in the art should appreciate and understand that one illustrative embodiment of the present invention includes a process for extracting natural gas liquids from a mixture of hydrocarbons produced from a reservoir. Such a process may included the steps of: successively distilling the mixture to extract methane from the mixture; cooling and expanding the methane to produce liquefied natural gas and cold methane vapor; recompressing at least a portion of the cold methane vapor; and reinjecting at least part of the portion into the reservoir. The process may further include the steps of further distilling the mixture to extract ethane; cooling the ethane; and combining the ethane with the liquefied natural gas. In cooling the ethane a heat exchange between the ethane and the cold methane vapor may be utilized. An additional step of cooling and expanding a portion of the recompressed portion of cold methane vapor to produce additional liquefied natural gas and additional cold methane vapor may be optionally included.

Another illustrative embodiment of the process disclosed herein for producing liquefied natural gas from methane gas, may include the steps of: supplying the methane gas for the process from an outlet of the demethanizer; cooling and expanding the methane gas; and separating liquefied natural gas from cold methane vapor. This process may be carried out in the vicinity of a producing natural gas reservoir having an associated natural gas liquids extraction apparatus comprising a demethanizer. An additional step may include cooling the methane gas from the demethanizer outlet by exchanging heat between the cold methane vapor and the methane gas. The natural gas liquids extraction apparatus utilized may include a deethanizer, such that the process may further include mixing ethane produced by the deethanizer with the liquefied natural gas.

Yet another illustrative embodiment of the present invention includes a process for separating a mixture of hydrocarbons which may include the steps: cooling the mixture by heat exchange with a cold methane stream; distilling the cooled mixture in a demethanizer column to produce methane-rich and methane-lean fractions; distilling the methane-lean fraction in a deethanizer column to produce ethane-rich and ethane-lean fractions; cooling the methane-rich and ethane-rich fractions by heat exchange with the cold methane stream; expanding and cooling the cooled methane-rich fraction; separating the expanded and cooled methane-rich fraction to produce a first methane-rich vapor and a first methane-rich liquid; mixing the first methane-rich vapor with a second methane-rich vapor to form the cold methane stream; compressing the cold methane stream to form a compressed methane stream; injecting a portion of the compressed methane stream into a producing hydrocarbon reservoir; cooling and expanding the remaining portion of the compressed methane stream to form an incremental methane stream; separating the incremental methane stream to produce the second methane-rich vapor and a second methane-rich liquid; mixing the first and second methane-rich liquids with the cooled ethane-rich fraction to produce a product mixture; expanding the product mixture; performing a vapor-liquid separation of the expanded product mixture to produce fuel gas and liquefied natural gas. The process may further include the step of separating the ethane-lean fraction into propane, butane and condensate by passing the ethane-lean fraction successively through depropanizer and debutanizer distillation columns. The expansion steps noted above may be performed in turbines, thereby generating energy for carrying out the cooling steps.

One of skill in the art should also realize and appreciate that the present invention may also encompass an apparatus for producing liquefied natural gas from methane gas. Such an apparatus may include: means for cooling the methane gas; means for expanding the gas; means for separating liquefied natural gas from cold methane vapor; and a conduit to a methane gas inlet of the apparatus from a methane outlet of a demethanizer, the demethanizer being a component of a natural gas liquids extraction apparatus. A deethanizer may be included in this apparatus such that there is a fluid connection between an ethane outlet of the deethanizer and a liquefied natural gas outlet of the separating means.

The present invention also includes an apparatus for simultaneously producing liquefied natural gas and extracting natural gas liquids from a mixture of hydrocarbons which may include: a demethanizer for distilling the mixture to produce methane and a demethanizer bottoms fraction; a deethanizer for further distilling the demethanizer bottoms fraction to produce ethane and a deethanizer bottoms fraction; a depropanizer for further distilling the deethanizer bottoms fraction to produce propane and a depropanizer bottoms fraction; a debutanizer for further distilling the depropanizer bottoms fraction to produce butane and condensate; a turbo-expander for expanding and cooling the methane; a separator whereby the methane is separated into liquefied natural gas and cold methane vapor; a compressor for recompressing the cold methane vapor; and a conduit connected between the compressor and a natural gas well such that at least a portion of the compressed methane vapor is injected into a producing hydrocarbon reservoir. Such an apparatus may also include a heat exchanger connected between the demethanizer and the turbo-expander whereby the methane overhead is cooled by the cold methane vapor before the cold methane vapor is recompressed. The apparatus may optionally contain a deethanizer for removing ethane from the demethanizer bottoms fraction before the fraction enters the depropanizer; and a conduit whereby the ethane is mixed with the liquefied natural gas produced in the separator. A heat exchanger connected between the deethanizer and the conduit may also be included, whereby the ethane is cooled by the cold methane vapor before mixing with the liquefied natural gas. The apparatus can further include a second turbo-expander whereby a portion of the portion of cold methane vapor recompressed by the compressor is expanded and cooled to produce additional liquefied natural gas.

All of the processes and apparatus disclosed and claimed herein may be made and executed without undue experimentation in light of the present disclosure. While the compositions and methods of this invention have been described in terms of preferred embodiments, it should be apparent to those of skill in the art that variations may be applied to the processes and apparatus and in the steps or in the sequence of steps of the method described herein without departing from the concept and scope of the invention. All such similar substitutes and modifications apparent to those skilled in the art are considered to be within the scope and concept of the invention as defined by the appended claims.

What is claimed is:

1. A process for extracting natural gas liquids from a mixture of hydrocarbons produced from a reservoir, comprising:

successively distilling the mixture to extract a methane overhead fraction from the mixture;

cooling and expanding the methane overhead fraction to produce liquefied natural gas and cold methane vapor;

recompressing at least a portion of the cold methane vapor; and reinjecting at least part of the recompressed portion into the reservoir.

2. The process of claim 1, further comprising:

further distilling the mixture to extract an ethane overhead fraction;

cooling the ethane overhead fraction to give a cooled ethane overhead fraction; and combining the cooled ethane overhead fraction with the liquefied natural gas.

3. The process of claim 2 wherein cooling the ethane overhead fraction comprises heat exchange between the ethane overhead fraction and the cold methane vapor.

4. The process of claim 1, further comprising cooling and expanding a portion of the recompressed portion of cold methane vapor to produce additional liquefied natural gas and additional cold methane vapor.

5. The process of claim 4, further comprising:

further distilling the mixture to extract ethane;

cooling the ethane; and combining the cooled ethane with the liquefied natural gas.

6. The process of claim 1, wherein cooling the methane overhead fraction comprises heat exchange between the methane overhead fraction and the cold methane vapor.

7. The process of claim 6, further comprising:

further distilling the mixture to extract ethane;

cooling the ethane; and combining the ethane with the liquefied natural gas.

8. A process for producing liquefied natural gas from methane gas, wherein the process is carried out in the vicinity of a hydrocarbon producing reservoir having an associated natural gas liquids extraction apparatus comprising a demethanizer, the process comprising:

supplying the methane gas for the process from an outlet of the demethanizer;

cooling and expanding the methane gas; and separating liquefied natural gas from cold methane vapor.

9. The process of claim 8, further comprising cooling the methane gas from the demethanizer outlet by exchanging heat between the cold methane vapor and the methane gas.

10. The process of claim 8 wherein the natural gas liquids extraction apparatus further comprises a deethanizer, the process further comprising mixing ethane produced by the deethanizer with the liquefied natural gas.

11. An apparatus for producing liquefied natural gas from methane gas, comprising:

means for cooling the methane gas;

means for expanding the gas;

means for separating liquefied natural gas from cold methane vapor; and a conduit to a methane gas inlet of the apparatus from a methane outlet of a demethanizer, the demethanizer being a component of a natural gas liquids extraction apparatus.

12. The apparatus of claim 11, wherein the natural gas liquids extraction apparatus further comprises a deethanizer, and the apparatus further comprises a connection between an ethane outlet of the deethanizer and a liquefied natural gas outlet of the separating means.

13. An apparatus for simultaneously producing liquefied natural gas and extracting natural gas liquids from a mixture of hydrocarbons, the apparatus comprising:

a demethanizer for distilling the mixture to produce a methane overhead fraction and a demethanizer bottoms fraction;

a turbo-expander for expanding and cooling the methane;

a separator whereby the methane is separated into liquefied natural gas and cold methane vapor;

a compressor for recompressing the cold methane vapor; and a conduit connected between the compressor and a producing hydrocarbon reservoir such that at least a portion of the compressed methane vapor is injected into the producing hydrocarbon reservoir.

14. The apparatus of claim 13, further comprising a heat exchanger connected between the demethanizer and the turbo-expander whereby the methane overhead fraction is cooled by the cold methane vapor before the cold methane vapor is recompressed.

15. The apparatus of claim 13, further comprising a second turbo-expander whereby a portion of the portion of cold methane vapor recompressed by the compressor is expanded and cooled to produce additional liquefied natural gas.

16. The apparatus of claim 13, further comprising:

a deethanizer for removing ethane from the demethanizer bottoms fraction to produce ethane and a deethanizer bottoms fraction; and a conduit whereby the ethane is mixed with the liquefied natural gas produced in the separator.

17. The apparatus of claim 16 further comprising a heat exchanger connected between the deethanizer and the conduit, whereby the ethane is cooled by the cold methane vapor before mixing with the liquefied natural gas.

18. The apparatus of claim 16, further comprising:

a depropanizer for further distilling the deethanizer bottoms fraction to produce propane and a depropanizer bottoms fraction; and a debutanizer for further distilling the depropanizer bottoms fraction to produce butane and condensate.

19. The apparatus of claim 18 further comprising a heat exchanger connected between the deethanizer and the conduit, whereby the ethane is cooled by the cold methane vapor before mixing with the liquefied natural gas.

20. A process for producing liquefied natural gas from a mixture containing methane, ethane, and heavier hydrocarbons, comprising:

separating the hydrocarbon mixture into a methane-rich fraction and a methane-lean fraction;

cooling and expanding the methane-rich fraction;

separating the expanded methane-rich fraction into methane-rich liquid and methane-rich vapor, at least a portion of the methane-rich vapor accomplishing the cooling of the methane-rich fraction by heat exchange therewith;

separating at least a portion of the ethane from the methane-lean fraction;

cooling the ethane by heat exchange with at least a portion of the methane-rich vapor;

combining the methane-rich liquid with the cooled ethane to form a product mixture;

expanding the product mixture;

separating the product mixture into a liquid product and a gas product; and recompressing the methane-rich vapor and reinjecting at least a portion of the recompressed vapor into a producing hydrocarbon reservoir.

21. The process of claim 20 wherein the expansion steps are performed in turbines, thereby generating energy for carrying out the cooling steps.

22. The process of claim 20, wherein the improvement further comprises cooling and expanding a portion of the recompressed vapor to produce additional product mixture and methane-rich vapor.

23. A process for producing ethane-enriched liquefied natural gas from a mixture of hydrocarbons, comprising:

distilling the mixture successively to produce a condensate product and a plurality of overhead products, one of the overhead products comprising methane and another comprising ethane;

liquefying at least a portion of the ethane overhead product and a first portion of the methane overhead product to form a liquefied natural gas product;

cooling the hydrocarbon mixture, the methane overhead product, and the ethane overhead product by heat exchange with a second portion of the methane overhead product; and recompressing the second portion and injecting at least part of the second portion into a producing hydrocarbon reservoir.

24. The process of claim 23, wherein the first portion of the methane overhead product comprises a liquid portion and the second portion comprises a vapor portion.

25. The process of claim 23 further comprising cooling and expanding at least part of the recompressed second portion to produce additional liquefied natural gas product.

26. A process for separating a mixture of hydrocarbons comprising:

(a) cooling the mixture by heat exchange with a cold methane stream;

(b) distilling the cooled mixture in a demethanizer column to produce methane-rich and methane-lean fractions;

(c) distilling the methane-lean fraction in a deethanizer column to produce ethane-rich and ethane-lean fractions;

(d) cooling the methane-rich and ethane-rich fractions by heat exchange with the cold methane stream;

(e) expanding the cooled methane-rich fraction;

(f) separating the expanded methane-rich fraction to produce a first methane-rich vapor and a first methane-rich liquid;

(g) mixing the first methane-rich vapor with a second methane-rich vapor to form the cold methane stream;

(h) compressing the cold methane stream to form a compressed methane stream;

(i) injecting a portion of the compressed methane stream into a producing hydrocarbon reservoir;

(j) cooling and expanding the remaining portion of the compressed methane stream to form an incremental methane stream;

(k) separating the incremental methane stream to produce the second methane-rich vapor and a second methane-rich liquid;

(l) mixing the first and second methane-rich liquids with the cooled ethane-rich fraction to produce a product mixture;

(m) expanding the product mixture;

(n) performing a vapor-liquid separation of the expanded product mixture to produce fuel gas and liquefied natural gas.

27. The process of claim 26, further comprising separating the ethane-lean fraction into propane, butane and condensate by passing the ethane-lean fraction successively through depropanizer and debutanizer distillation columns.

28. The process of claim 26 wherein the expansion steps are performed in turbines, thereby generating energy for carrying out the cooling steps.

* * * * *